United States Patent [19]

Sato et al.

[11] Patent Number: 4,789,623

[45] Date of Patent: Dec. 6, 1988

[54] METHOD FOR FORMING AN IMAGE

[75] Inventors: Kozo Sato; Hideki Naito, both of Kanagawa, Japan

[73] Assignee: Fuji Photo Film Co., Ltd., Kanagawa, Japan

[21] Appl. No.: 937,289

[22] Filed: Dec. 3, 1986

[30] Foreign Application Priority Data

Dec. 3, 1985 [JP] Japan ..... 60-270648

[51] Int. Cl.[4] ..... G03C 5/24

[52] U.S. Cl. ..... 430/351; 430/955; 430/543; 430/617; 430/203

[58] Field of Search ..... 430/617, 619, 620, 351, 430/543, 566, 467, 405, 203, 955

[56] References Cited

U.S. PATENT DOCUMENTS

| | | | |
|---|---|---|---|
| 4,021,240 | 5/1977 | Cerquone et al. | 430/467 |
| 4,426,441 | 1/1984 | Adin et al. | 430/467 |
| 4,504,568 | 3/1985 | Clark et al. | 430/351 |
| 4,590,152 | 5/1986 | Sato et al. | 430/351 |

*Primary Examiner*—Won H. Louie

*Attorney, Agent, or Firm*—Sughrue, Mion, Zinn, Macpeak & Seas

[57] ABSTRACT

A method for forming an image comprising heating in the presence of at least one of a base and a base generating agent, a heat-developable color light-sensitive material which comprises a support having thereon at least: (1) a light-sensitive silver halide, (2) a coupler capable of coupling with an oxidation product of a developing agent, (3) a hydrophilic binder, and (4) at least one compound represented by formula (Z)

[Z]

wherein $R_1$, $R_2$, $R_3$, and $R_4$ each represents a hydrogen atom, a halogen atom, an alkyl group, an alkenyl group, a cycloalkyl group, an aralkyl group, a hydroxy group, an amino group, a substituted amino group, an alkoxy group, an acylamino group, an alkylsulfonylamino group, an arylsulfonylamino group, an aryl group, a carbamoyl group, a substituted carbamoyl group, a sulfamoyl group, a substituted sulfamoyl group, an acyl group, an acyloxy group, or an alkoxycarbonyl group, or $R_1$ and $R_2$, or $R_3$ and $R_4$ are connected together to form a ring structure; A represents a hydroxy group, a group capable of providing a hydroxy group upon reaction with a nucleophilic reagent, or the group wherein $R_6$ and $R_7$ each represents a hydrogen atom, a substituted or unsubstituted alkyl group, a substituted or unsubstituted alkenyl group, a substituted or unsubstituted cycloalkyl group, or a substituted or unsubstituted aralkyl group, or $R_6$ and $R_7$ are connected together to form a heterocyclic group, or when A represents the group at least one combination of $R_1$ and $R_6$, and $R_3$ and $R_7$ is connected together to form a heterocyclic group; and $R_5$ represents a substituted or unsubstituted aryl group or a substituted or unsubstituted heterocyclic group.

20 Claims, No Drawings

METHOD FOR FORMING AN IMAGE

FIELD OF THE INVENTION

The present invention relates to a method for forming an image, and more particularly to a method for forming an image comprising heating in the presence of a base or base generator, a heat-developable color light-sensitive material containing a precursor of a developing agent which has excellent preservability before use and provides color images having a high image density and a low fog density.

BACKGROUND OF THE INVENTION

Photographic processes using silver halide have been most widely used in the past due to their excellent photographic properties such as sensitivity or control of gradation, etc., as compared with other photographic processes, such as an electrophotographic process or a diazo photographic process. In recent years, with respect to image formation processes for light-sensitive materials using silver halide, many techniques capable of easily and quickly obtaining images have been developed by changing the conventional wet process using a developing solution into a dry development process such as a process using heat, etc.

Heat-developable light-sensitive materials are known in the field of these techniques. Heat-developable light-sensitive materials and processes therefore have been described, for example, in U.S. Pat. Nos. 3,152,904, 3,301,678, 3,392,020, and 3,457,075, British Patent Nos. 1,131,108 and 1,167,777, and *Research Disclosure,* RD No. 17029, pages 9 to 15 (June, 1978).

Many different processes for obtaining color images have been proposed. With respect to processes for forming color images by the coupling of an oxidation product of a developing agent with a coupler, it has been proposed to use a p-phenylenediamine type reducing agent and a phenolic coupler or an active methylene coupler as described in U.S. Pat. No. 3,531,286, a p-aminophenol type reducing agent as described in U.S. Pat. No. 3,761,270, a sulfonamidophenol type reducing agent as described in Belgian Patent No. 802,519 and *Research Disclosure,* pages 31 and 32 (September 1975) and the combination of a sulfonamidophenol type reducing agent and a 4-equivalent coupler as described in U.S. Pat. No. 4,021,240.

A process in which a diffusible dye is released upon the coupling of an oxidation product of a developing agent with a coupler is described in Japanese Patent Application (OPI) No. 79247/83, etc. (the term "OPI" as used herein means an "unexamined published patent application").

However, such developing agents which are employed in these known heat-developable color light-sensitive materials, for example, p-phenylenediamines or p-aminophenols are inferior in their preservability and cause remarkable coloration in non-image areas. On the other hand, p-sulfonamidophenols have a poor silver developing property and a poor coupling property and can not provide color images of high density, although they have improved preservability.

Moreover, hydrazone derivatives as described in *Research Disclosure,* RD No. 19417 (June, 1980) have a poor coupling property and can only provide color images of low density. Furthermore, sulfamic acid salts as described in Japanese Patent Application (OPI) No. 146133/81, urea derivatives as described in U.S. Pat. No. 4,426,441, and urea derivatives as described in Japanese Patent Application (OPI) No. 53831/84, etc. are compounds in which p-phenylenediamines or p-aminophenols are stabilized by means of protective groups. However, these compounds also have a poor silver developing property and can only provide color images of low density.

SUMMARY OF THE INVENTION

Therefore, an object of the present invention is to provide a method for forming an image using a heat-developable color light-sensitive material which is excellent in stability during storage before use and can provide color images having high image density and a high S/N (signal/noise) ratio.

Another object of the present invention is to provide a precursor of a developing agent suitable for use in a heat-developable color light-sensitive material which is excellent in stability during storage before use, silver developing properties, and coupling properties.

These and other objects of the present invenion will become more apparent from the following detailed description and examples.

These objects of the present invention are accomplished by using, as a developing agent, a compound represented by formula (Z).

More specifically, the objects of the present invention are accomplished by a method for forming an image which comprises heating in the presence of at least one of a base and a base generating agent, a heat-developable color light-sensitive material comprising a support having thereon at least: (1) a light-sensitive silver halide, (2) a coupler capable of coupling with an oxidation product of a developing agent, (3) a hydrophilic binder, and (4) at least one compound represented by formula (Z):

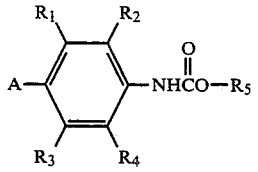

[Z]

wherein $R_1$, $R_2$, $R_3$, and $R_4$ each represents a hydrogen atom, a halogen atom, an alkyl group, an alkenyl group, a cycloalkyl group, an aralkyl group, a hydroxy group, an amino group, a substituted amino group, an alkoxy group, an acylamino group, an alkylsulfonylamino group, an arylsulfonylamino group, an aryl group, a carbamoyl group, a substituted carbamoyl group, a sulfamoyl group, a substituted sulfamoyl group, an acyl group, an acyloxy group or an alkoxycarbonyl group, or $R_1$ and $R_2$, or $R_3$ and $R_4$ are connected together to form a ring; A represents a hydroxy group, a group capable of providing a hydroxy group upon reaction with a nucleophilic reagent, or a group of

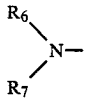

(wherein $R_6$ and $R_7$ each represents a hydrogen atom, a substituted or unsubstituted alkyl group, a substituted or unsubstituted alkenyl group, a substituted or unsubstituted cycloalkyl group or a substituted or unsubstituted aralkyl group, or $R_6$ and $R_7$ are connected to each other to form a heterocyclic group), or when A represents the group of

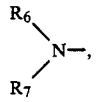

$R_1$ and $R_6$ and/or $R_3$ and $R_7$ are connected to each other to form a heterocyclic group; $R_5$ represents a substituted or unsubstituted ariyl group or a substituted or unsubstituted heterocyclic group.

DETAILED DESCRIPTION OF THE INVENTION

The compound represented by formula (Z) used as a precursor of a developing agent in the present invention is described in detail below.

In formula (Z), $R_1$, $R_2$, $R_3$ and $R_4$ each independently represents a hydrogen atom, a halogen atom (e.g., a chlorine atom, a bromine atom, a fluorine atom, etc.), an alkyl group preferably having from 1 to 32 carbon atoms (e.g., a methyl group, an ethyl group, an octyl group, etc.), an alkenyl group preferably having from 2 to 32 carbon atoms (e.g., an allyl group, a vinyl group, a crotyl group, etc.), a cycloalkyl group preferably having from 3 to 8 carbon atoms (e.g., a cyclohexyl group, a cyclopentyl group, etc.), an aralkyl group preferably having from 7 to 18 carbon atoms (e.g., a benzyl group, an $\alpha$-methylbenzyl group, a $\beta$-phenetyl group, etc.), a hydroxy group, an amino group, a substituted amino group, an alkoxy group preferably having from 1 to 32 carbon atoms (e.g., a methoxy group, a methoxy ethoxy group, a butoxy group, etc.), an acylamino group preferably having from 2 to 32 carbon atoms (e.g., an acetylamino group, a hexanoylamino group, an octanoylamino group, a stearoylamino group, etc.), an alkylsulfonylamino group preferably having from 1 to 32 carbon atoms (e.g., a methylsulfonylamino group, an octylsulfonylamino group, etc.), an arylsulfonylamino group preferably having from 6 to 18 carbon atoms (e.g., a phenylsulfonylamino group, a p-chlorophenylsulfonylamino group, etc.), an aryl group (e.g., a phenyl group, a naphthyl group, etc.), a carbamoyl group, a substituted carbamoyl group, a sulfamoyl group, a substituted sulfamoyl group, an acyl group preferably having from 2 to 32 carbon atoms (e.g., an acetyl group, a benzoyl group, etc.), an acyloxy group preferably having from 2 to 32 carbon atoms (e.g., an acetyloxy group, a benzoyloxy group, etc.) or an alkoxycarbonyl group preferably having from 2 to 32 carbon atoms (e.g., a methoxycarbonyl group, an ethoxycarbonyl group, etc.), or $R_1$ and $R_2$, or $R_3$ and $R_4$ are connected to each other to form a ring structure (e.g., a saturated ring with a trimethylene group, a tetramethylene group, etc., or a naphthalene ring with a benzoloque).

In formula (Z), when $R_1$, $R_2$, $R_3$, or $R_4$ represents an aliphatic hydrocarbon group such as an alkyl group or an alkenyl group, etc., or a group containing an aliphatic hydrocarbon group such as an aralkyl group, an alkoxy group, an acylamino group, etc., the aliphatic hydrocarbon group may be a straight chain or branched chain. Further, when $R_1$, $R_2$, $R_3$, or $R_4$ represents one of the substituents as defined above other than a hydrogen atom, a halogen atom, and a hydroxy group, it may have one or more substituents including substituting atoms (hereinafter referred to as substituents). Examples of the substituents are described below as substituents for the group represented by $R_1$, $R_2$, $R_3$ or $R_4$. When two or more substituents are present, they may be the same or different.

Examples of the substituents for the group represented by $R_1$, $R_2$, $R_3$ or $R_4$ include an aliphatic group, an aryl group, an aryl group, a heterocyclic group, an aliphatic oxy group, an aromatic oxy group, an acyl group, an ester group, an amido group, an imido group, an aliphatic sulfonyl group, an arylsulfonyl group, a heterocyclic sulfonyl group, an aliphatic thio group, an arylthio group, a heterocyclic thio group, a hydroxy group, a cyano group, a carboxy group, a sulfo group, or a nitro group, etc.

Substituents for the substituted amono group, the substituted carbamoyl group or the substituted sulfamoyl group represented by $R_1$, $R_2$, $R_3$, or $R_4$ are the same as those substituents described above for $R_1$, $R_2$, $R_3$, or $R_4$.

A represents a hydroxy group, a precursor thereof, or a group of

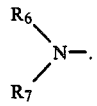

The precursor of a hydroxy group means a group capable of providing a hydroxy group upon reaction with a nucleophilic reagent. The nucleophilic reagent includes an anionic reagent such as $OH^-$, $OR^-$, $SO_3^{-2}$, etc., and a compound having a lone pair of electrons such as a primary or secondary amine, a hydrazine, a hydroxylamine, an alcohol, a thiol, etc.

Examples of the precursors of a hydroxy group include an acyloxy group preferably having from 2 to 18 carbon atoms (e.g., an acetoxy group, a benzoyloxy group, etc.), an alkylsulfonyloxy group preferably having from 1 to 12 carbon atoms (e.g., a methanesulfonyloxy group, an octylsulfonyloxy group, etc.), an arylsulfonyloxy group preferably having from 6 to 18 carbon atoms (e.g., a phenylsulfonyloxy group, etc.), an alkoxycarbonyloxy group preferably having from 2 to 18 carbon atoms (e.g., an ethoxycarbonyloxy group, an isobutyroyloxy group, etc.), an aryloxycarbonyloxy group preferably having from 7 to 18 carbon atoms (e.g., a phenoxycarbonyloxy group, etc.), a dialkylphosphoryloxy group preferably having from 2 to 16 carbon atoms (e.g., a diethylphosphoryloxy group, etc.), or an diarylphosphoryloxy group preferably having from 12 to 24 carbon atoms (e.g., a diphenylphosphoryloxy group, etc.), etc.

When A represents the group of

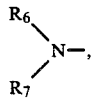

$R_6$ and $R_7$ each independently represents a hydrogen atom, a substituted or unsubstituted alkyl group preferably having from 1 to 32 carbon atoms (e.g., a methyl group, an ethyl group, a dodecyl group, a methanesulfonylaminoethyl group, a hydroxyethyl group, etc.), a substituted or unsubstituted alkenyl group preferably having from 2 to 18 carbon atoms (e.g., an allyl group, a cinnamyl group, etc.), a substituted or unsubstituted cycloalkyl group preferably having from 3 to 12 carbon atoms (e.g., a cyclohexyl group, etc.) or a substituted or unsubstituted aralkyl group preferably having from 7 to 18 carbon atoms (e.g., a benzyl group, a β-phenethyl group, etc.), or $R_6$ and $R_7$ may be connected to each other to form a heterocyclic group (e.g., a pyrrolidine ring, a piperidine ring, a morpholine ring, etc.). Further, $R_1$ and $R_6$ and/or $R_3$ and $R_7$ may be connected to each other to form a heterocyclic group, for example, a tetrahydroquinoline ring, a durolidine ring, etc.

$R_5$ represents a substituted or unsubstituted aryl group or a substituted or unsubstituted heterocyclic group which may be condensed. $R_5$ preferably represents a substituted or unsubstituted aryl group having 6 to 20 carbon atoms (e.g., a phenyl group, an α-naphthyl group, a β-naphthyl group, a p-tolyl group, an o-chlorophenyl group, a p-chlorophenyl group, a 2,4-dichlorophenyl group, a 2,4,6-trichlorophenyl group, a p-bromophenyl group, a 2,4-dibromophenyl group, a 2,4,6-tribromophenyl group, a p-cyanophenyl group, a p-methanesulfonylphenyl group, a p-(1-propylsulfonyl)phenyl group, a m-nitrophenyl group, a 6-bromo-β-naphthyl group, a 2,4-dichloro-α-naphthyl group, etc.) or a 5- or 6-membered substituted or unsubstituted heterocyclic group (e.g., a 1-pyridyl group, a 2-pyridyl group, a 3-pyridyl group, a 2-quinolyl group, a 4-quinolyl group, etc.). Substituents for the substituted aryl group or the substituted heterocyclic group represented by $R_5$ are the same as those substituents described for $R_1$, $R_2$, $R_3$ or $R_4$.

Preferred examples of $R_1$, $R_2$, $R_3$, and $R_4$ include a hydrogen atom, a halogen atom, an alkyl group, an alkoxy group, an acylamino group, an aryl group, a carbamoyl group or a substituted carbamoyl group, etc.

Preferred examples of A include a hydroxy group, an acyloxy group, an alkylsulfonyloxy group, an arylsulfonyloxy group, an alkoxycarbonyloxy group, an aryloxycarbonyloxy group, a dialkylphosphoryloxy group, a diarylphosphoryloxy group, a dialkylamino group (the alkyl groups may be substituted), a pyrrolidino group, a piperidino group or a morpholino group, etc.

Preferred examples of $R_5$ include a phenyl group, a substituted phenyl group, a naphthyl group, a substituted naphthyl group, a pyridyl group or a substituted pyridyl group, etc.

Preferred examples of the precursors of developing agents represented by formula (Z) above according to the present invention are specifically set forth below, but the present invention is not to be construed as being limited to these compounds.

1.

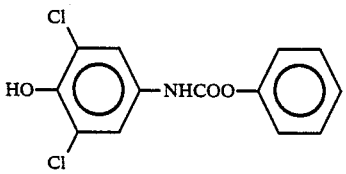

2.

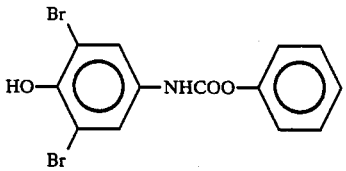

-continued

3.

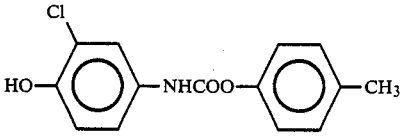

4.

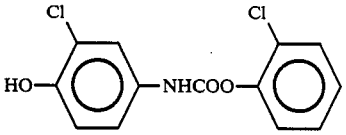

5.

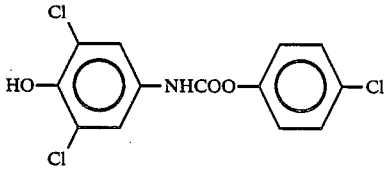

6.

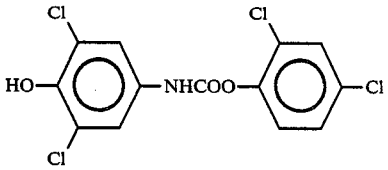

7.

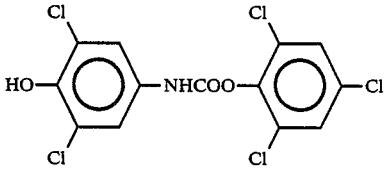

8.

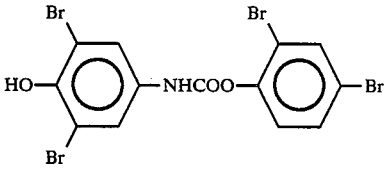

9.

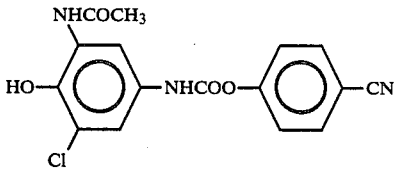

10.

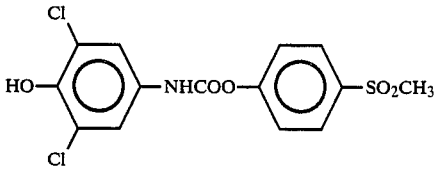

11.

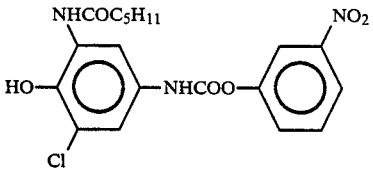

-continued
12.
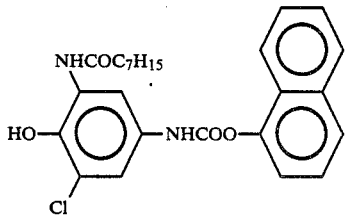
13.
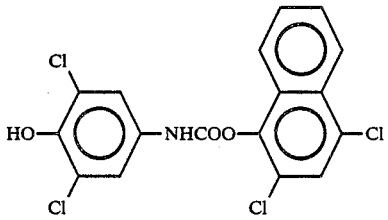
14.
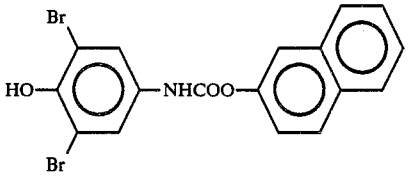
15.
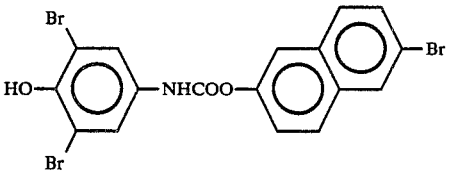
16.
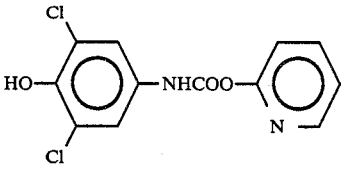
17.
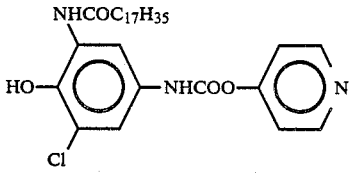
18.
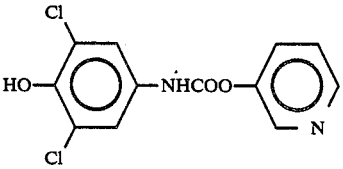
19.
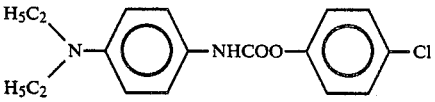
20.
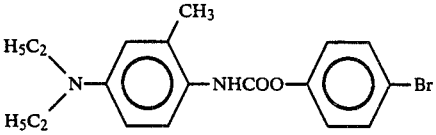
-continued
21.
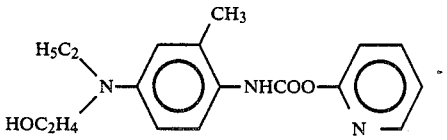
22.
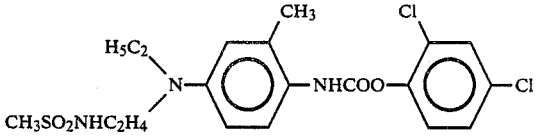
23.
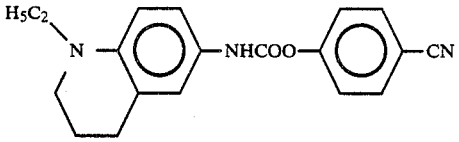
24.
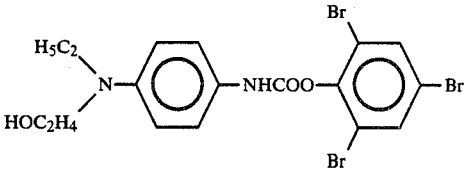
25.
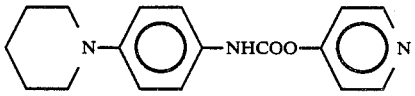
26.
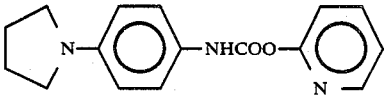
27.
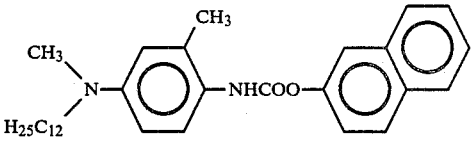
28.
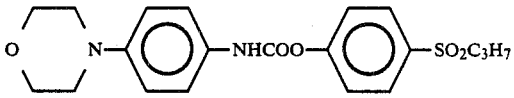
29.
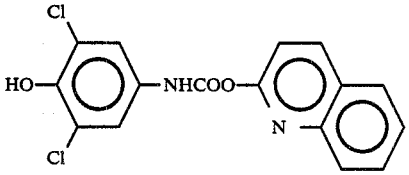
30.
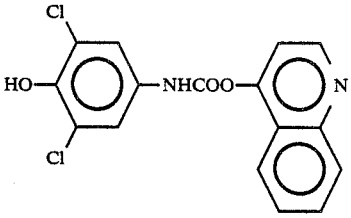

-continued

31.

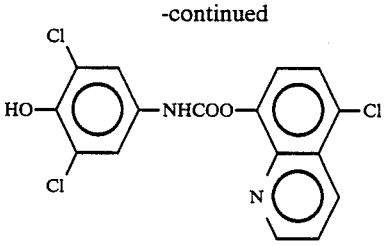

The precursors of developing agents used in the present invention can be synthesized by known methods, for example, condensation reaction of anilines with chloroformic acid esters or carbonic acid esters.

A synthesis example of the precursor of a eeveloping agent used in the present invention is specifically described below.

SYNTHESIS EXAMPLE

Synthesis of Compound 1

To a mixture of 35.6 g of 2,6-dichloro-4-aminophenol and 400 ml of acetonitrile was added drop-wise 15.7 g of phenyl chloroformate at room temperature. After stirring at room temperature for 1 hour, the crystals thus-deposited were removed by filtration. The filtrate was condensed under a reduced pressure and the crystals thus-deposited were collected by filtration. The crude crystals were recrystallized from acetonitrile to obtain 14.8 g of Compound 1 as white crystals. Melting Point: 182° to 183° C.

The other precursors of developing agents used in the present invention can be synthesized by analogous synthesis method as the above Synthesis Example by appropriately selecting commonly available reagents.

The above described precursors of developing agents represented by formula (Z) according to the present invention can be used either individually or in a combination two or more thereof. They can generally be employed in a range of from about 0.1 mol to about 10 mols, preferably from about 0.2 mol to about 3 mols, per mol of the total coated amount of silver constituting the light-sensitive layer.

The precursors of developing agents according to the present invention may be incorporated into light-sensitive materials in various manners. According to a method which is conventionally known as the oil protected method, they may be dissolved in a hydrophobic oil and then the solution is emulsified or dispersed in water or a hydrophilic colloid solution to prepare an oil-in-water type dispersion. Also, they can be dissolved in a water-miscible solvent and then the solution is added to water or a hydrophilic colloid solution in the form of fine particles. Further, the solid compounds can be introduced into water or a hydrophilic binder using a ball mill, etc.

The precursors of developing agents represented by formula (Z) used in the present invention can be added to any constituting layer of the heat-developable color light-sensitive material, for example, a light-sensitive silver halide emulsion layer, a hydrophilic colloid layer, an intermediate layer, etc.

Various kinds of couplers capable of coupling with an oxidation product of a developing agent are known. For example, any of the couplers described in T. H. James, *The Theory of the Photographic Process,* 4th Ed., pages 354 to 361, and Shinichi Kikuchi, *Shashin Kaqaku,* 4th Ed., pages 284 to 295 (Kyoritsu Shuppan), etc., can be utilized in the present invention.

In the present invention, both 4-equivalent couplers in which a hydrogen atom is attached to the position at which the coupler is connected to an oxidation product of a developing agent and 2-equivalent couplers in which the coupling position is substituted with a releasing group can be employed. Further, not only so-called Fischer dispersion type couplers which have a hydrophilic group as well as a hydrophobic diffusion-resistant group in their molecules, but also so-called oil-protected dispersion type couplers which have only a hydrophobic diffusion-resistant group can be employed.

Couplers having a diffusion-resistant group include couplers having a hydrophobic ballast group in their releasing groups as described in Japanese Patent Application (OPI) No. 149046/83, etc.; couplers in which the releasing groups are connected to a main chain of a polymer as described in Japanese Patent Application (OPI) No. 149047/83, etc.; and polymer couplers as described in U.S. Pat. Nos. 3,370,952, 3,451,820, 4,080,211, 4,215,195 and 4,409,320, etc.

Furthermore, colored couplers which contain a dye portion in their releasing groups such as those described in British Patent No. 1,330,524, Japanese Patent Publication No. 39165/73, Japanese Patent Application (OPI) Nos. 186744/82, 207250/82 and 79247/83, etc. are useful in the present invention.

Preferred couplers which can be used in the present invention include active methylene compounds, active methine compounds, phenols, naphthols, pyrazole compounds, and condensed pyrazole compounds.

Particularly preferred couplers which can be used in the present invention is represented by the following formulae (I) to (X)

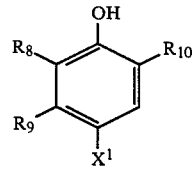

(I)

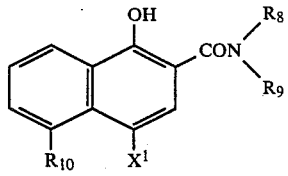

(II)

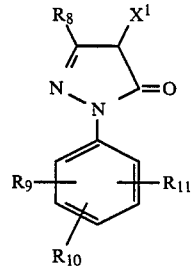

(III)

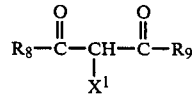

(IV)

-continued (V)

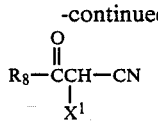

(VI)

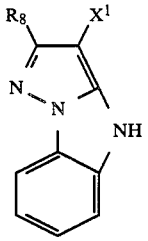

(VII)

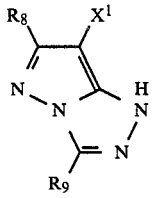

(VIII)

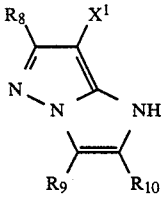

(IX)

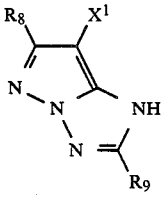

(X)

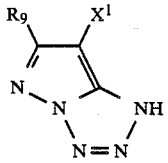

wherein $R_8$, $R_9$, $R_{10}$, and $R_{11}$ each represents a substituent selected from a hydrogen atom, a halogen atom, an alkyl group, a cycloalkyl group, an aralkyl group, an alkenyl group, an aryl group, an alkoxy group, an aryloxy group, an acyl group, an acylamino group, an alkoxyalkyl group, an aryloxyalkyl group, a carbamoyl group, a substituted carbamoyl group, a sulfamoyl group, a substituted sulfamoyl group, an alkylamino group, an arylamino group, an acyloxy group, an acyloxyalkyl group, a substituted ureido group, a cyano group, and a heterocyclic group, and these substituents may further be substituted with an alkyl group, an alkoxy group, a halogen atom, a hydroxy group, a carboxy group, a sulfo group, a cyano group, a nitro group, a carbamoyl group, a substituted carbamoyl group, a sulfamoyl group, a substituted sulfamoyl group, an acylamino group, an alkylsulfonylamino group, an arylsulfonylamino group, an aryl group, an aryloxy group, an aralkyl group, or an acyl group; and $X^1$ represents a hydrogen atom or a coupling releasing group.

Representative examples of the coupling releasing groups include a halogen atom, an acyloxy group, a sulfonyloxy group, an alkoxy group, an aryloxy group, an alkylthio group, an arylthio group, an alkoxycarbonyloxy group, a dialkylcarbamoyloxy group, an imido group, an N-heterocyclic group, or a pyridinium group, etc.

It is preferred that any one of $R_8$, $R_9$, $R_{10}$, $R_{11}$, and $X^1$ includes a ballast group in order to render the coupler diffusion-resistant. Alternatively, any one of $R_8$, $R_9$, $R_{10}$, $R_{11}$, and $X^1$ may be connected to a main chain of a polymer.

Diffusion-resistant compounds capable of releasing a diffusible dye upon the coupling reaction with an oxidation product of a developing agent, i.e., dye releasing couplers can also be employed in the present invention. Typical examples of such compounds are those described in U.S. Pat. No. 3,227,550. Examples thereof are represented by formula (XI)

Coup - Link - Dye (XI)

wherein Coup represents a coupler residue capable of coupling with an oxidation product of a developing agent; Link is connected to the active point of the coupler residue and represents a group having a bond connected to the coupler residue which bond is capable of being cleaved when the dye releasing coupler represented by formula (XI) is subjected to the coupling reaction with an oxidation product of a developing agent; and Dye represents a dye or dye precursor.

In the above described formula (XI), preferred coupler residues represented by Coup are the residues formed by eliminating $X^1$ from the couplers represented by the above described formulae (I) to (X).

Preferred examples of Link include an azo group, an azoxy group, —O—, —Hg—, an alkylidene group, —S—, —S—S— or —$NHSO_2$—, etc. Also, the above described coupling releasing groups represented by $X^1$ are useful.

Preferred compounds of the dye releasing couplers represented by formula (XI) described above are those wherein Coup represents a phenol type coupler residue, a naphthol type coupler residue, or an indanone type coupler residue, and Link is connected to Coup through an oxygen atom or a nitrogen atom.

The couplers used in the present invention can be introduced into a layer of the light-sensitive material by known methods such as a method as described in U.S. Pat. No. 2,322,027. In this case, an organic solvent having a high boiling point or an organic solvents having a low boiling point as described below can be used. For example, the coupler is dispersed in a hydrophilic colloid after being dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a low boiling point of about 30° C. to 160° C., for example, a lower alkyl acetate such as ethyl acetate, butyl acetate, etc., ethyl propionate, secondary butyl alcohol, methyl isobutyl ketone, β-ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the coupler is dispersed in a hydrophilic colloid. For this purpose, the surface active agents as described in Japanese Patent Application (OPI) No. 157636/84 can be used.

The amount of the organic solvent having a high boiling point used in the present invention is generally 10 g or less, and preferably 5 g or less, per g of the coupler employed.

In the present invention, a reducing substance may be used together in the light-sensitive material. Suitable examples of the reducing substances include auxiliary developing agents which can be used together with the precursor of developing agent according to the present invention. The auxiliary developing agents may be diffusible or non-diffusible.

Examples of useful auxiliary developing agents include hydroquinone, alkyl-substituted hydroquinones such as tert-butylhydroquinone, 2,5-dimethylhydroquinone, etc., catechols, pyrogallols, halogen-substituted hydroquinones such as chlorohydroquinone, dichlorohydroquinone, etc., alkoxy-substituted hydroquinones such as methoxyhydroquinone, and polyhydroxybenzene derivatives such as methyl hydroxynaphthalene, etc. Further, these are methyl gallate, ascorbic acid, ascorbic acid derivatives, hydroxylamines such as N,N-di(2-ethoxyethyl)hydroxylamine, etc., pyrazolidones such as 1-phenyl-3-pyrazolidone or 4-methyl-4-hydroxymethyl-1-phenyl-3-pyrazolidone, etc., reductones, and hydroxy tetronic acids.

The auxiliary developing agent can be used in a certain concentration range. A generally useful concentration range is from 0.00005 mols to 10 mols, and a preferable range is from 0.001 mol to 0.5 mols, per mol of the total coated amount of silver.

Various known bases and base generating agents can be used in the present invention. The base or base generating agent is a compound capable of activating development upon rendering the system basic or a compound having nucleophilic properties. Such a compound is extremely effective for increase in the maximum density of an image formed. In particular, when in the present invention a precursor of the developing agent represented by formula (Z) is employed, it is necessary to use a base at the heat development for the purpose of revealing the development activity by eliminating the protective group from the precursor. In other words, the light-sensitive material is developed by heating in the presence of a base or a base generating agent according to the method of forming an image in the present invention. More specifically, the base or base generating agent can be added to the material at the time of preparation of the light-sensitive material, or it can be supplied from the outside at the time of heat development, for example, it can be supplied by dissolving it in water.

The base generating agent used in the present invention includes a base precursor and a compound utilized in the base generating system described hereinafter, for example, a compound which generates a base upon reaction with another compound. It is advantageous to use a base precursor among the base generating agents when added to the light-sensitive layer.

The term "base precursor" used herein means a compound capable of releasing a base by heating.

Preferred examples of the bases include inorganic bases, for example, hydroxides, secondary or tertiary phosphates, borates, carbonates, quinolinates, and metaborates of alkali metals or alkaline earth metals; ammonium hydroxides; quaternary alkylammonium hydroxides; and other metal hydroxides; etc., and organic bases, for example, aliphatic amines (trialkylamines, hydroxylamines and aliphatic polyamines), aromatic amines (N-alkylsubstituted aromatic amines, N-hydroxyalkyl-substituted aromatic amines and bis(p-(dialkylamino)phenyl)methanes), heterocyclic amines, amidines, cyclic amidines, guanidines and cyclic guanidines, etc. Further, betaine tetramethylammonium iodide and diaminobutane dihydrochloride as described in U.S. Pat. No. 2,410,644 and urea and organic compounds including amino acids such as 6-amonocaproic acid as described in U.S. Pat. No. 3,506,444 are useful. In the present invention, compounds having a pKa value of 8 or more are particularly useful.

As the base precursors, compounds which undergo reaction by heating to release a base, such as salts of an organic acid which is decarboxylated by heating to cause decomposition and a base, or compounds which are decomposed by a Lossen rearrangement of Beckmann rearrangement to release an amine, can be used.

Preferred base precursors include precursors of the above described organic bases. Examples include salts of thermally decomposable organic acid such as trichloroacetic acid, trifluoroacetic acid, propiolic acid, cyanoacetic acid, sulfonylacetic acid, acetoacetic acid, etc., and salts of 2-carboxycarboxamide as described in U.S. Pat. No. 4,088,496, etc.

Preferred examples of the base precursors are described. Examples of compounds which release a base by decarboxylation of the acid moiety in the following.

Examples of trichloroacetic acid derivatives include guanidine trichloroacetic acid, piperidine trichloroacetic acid, morpholine trichloroacetic acid, p-toluidine trichloroacetic acid, 2-picoline trichloroacetic acid, etc.

In addition, base precursors as described in British Patent No. 998,945, U.S. Pat. No. 3,220,846, Japanese Patent Application (OPI) No. 22625/75, etc., can be used.

As substances besides trichloroacetic acids, 2-carboxycarboxamide derivatives as described in U.S. Pat. No. 4,088,496, α-sulfonylacetate derivatives as described in U.S. Pat. No. 4,060,420, phenyl propiolic acid derivatives as described in Japanese Patent Application (OPI) No. 180549/84, salts of propiolic acid derivatives and bases as described in Japanese Patent Application (OPI) No. 180537/84, etc. Salts using alkali metal and alkaline earth metal as a base component besides organic bases are also effective and described in Japanese Patent Application (OPI) No. 195237/84 can be used.

As other precursors, hydroxamic carbamates utilizing Lossen rearrangement as described in Japanese Patent Application (OPI) No. 168440/84 and aldoxime carbamates which form nitrile as described in Japanese Patent Application (OPI) No. 157637/84, etc., are effective.

Further, amineimides as described in *Research Disclosure,* RD No. 15776 (May 1977) and aldonic amides as described in Japanese Patent Application (OPI) No. 22625/75 are preferably used, because they form a base by decomposition at a high temperature.

Moreover, a base generating system is particularly useful for the present invention, in which a base is formed by bringing two kinds of substances which are incorporated into a layer of the light-sensitive material and a layer of a dye fixing material, respectively, into contact with each other. Examples of such base generating systems include combinations of metal complexing agents and sparingly soluble metal salts such as calcium, magnesium, aluminium zinc, copper, etc.

These bases and base precursors can be used in an amount of a wide range. Preferred range is not more than 50% by weight, preferably, in the range from 0.01% by weight to 40% by weight based on the dry weight of the coating film of the light-sensitive material.

It is of course possible to use the above described bases or base precursors not only for acceleration of forming dye images, but also for other purposes, for example, control of pH value.

The above described various ingredients to constitute a heat-developable light-sensitive material used in the present invention can be arranged in arbitrarily suitable positions, if desired. For instance, one or more of the ingredients can be incorporated in one or more of the constituent layers of the light-sensitive material, if desired. In some cases, it may be preferred that particular portions of reducing agent, image stabilizing agent and/or other additives should be distributed in a protective layer.

The silver halide which can be used in the present invention may be any of silver chloride, silver bromide, silver chlorobromide, silver chloroiodide, and silver chloroiodobromide.

More specifically, any of silver halide emulsions as described in Japanese Patent Application (OPI) No. 107240/86, U.S. Pat. No. 4,500,626, and *Research Disclosure,* RD No. 17029, pages 9 to 10 (June, 1978), etc.

While the silver halide emulsion may be employed without being subjected to after-ripening, it is usually used after being chemically sensitized. A sulfur sensitization method, a reduction sensitization method, a noble metal sensitization method, etc., which are known in the field of emulsions for conventional type photographic light-sensitive materials can be applied singly or in combination. Chemical sensitization can be carried out in the presence of nitrogen-containing heterocyclic compounds as described in Japanese Patent Application (OPI) Nos. 126526/83 and 215644/83.

The silver halide emulsion used in the present invention may be of the surface latent image type in which a latent image is formed mainly on the surface of the particles, or of the internal latent image type in which a latent image is formed in the interior of the particles. A direct reversal emulsion in which an internal latent image type emulsion and a nucleating agent are used in combination can also be used.

The coated amount of the light-sensitive silver halide used in the present invention is generally in the range of from 1 $mg/m^2$ to 10 $g/m^2$, calculated as the amount of silver.

In the present invention, an organic metal salt can be used as an oxidizing agent in combination with the light-sensitive silver halide. In this case, it is necessary for the light-sensitive silver halide and the organic metal salt to be in contact with each other or be closely associated. Of these organic metal salts, organic silver salts are particularly preferably employed.

Examples of organic compounds which can be used for forming the above-described organic silver salt oxidizing agents include those as described in Japanese Patent Application (OPI) No. 107240/86, U.S. Pat. No. 4,500,626, etc. Further, a silver salt of a carboxylic acid having as alkynyl group such as silver phenylpropiolate as described in Japanese Patent Application (OPI) No. 113235/85 is useful in the present invention.

The organic silver salt described above can be employed in the range of from 0.01 mol to 10 mols, and preferably from 0.01 mol to 1 mol, per mol of the light-sensitive silver halide. The total coated amount of the light-sensitive silver halide and the organic silver salt is preferably from 50 $mg/m^2$ to 10 $g/m^2$, calculated as the amount of silver.

The silver halide used in the present invention can be spectrally sensitized with methine dyes or other dyes. Examples of the dyes which can be employed include cyanine dyes, merocyanine dyes, complex cyanine dyes, complex merocyanine dyes, holopolar cyanine dyes, hemicyanine dyes, styryl dyes, and hemioxonol dyes.

Specific examples of sensitizing dyes include those as described in Japanese Patent Application (OPI) Nos. 180550/84 and 140335/85, *Research Disclosure,* RD No. 17029, pages 12 to 13 (June, 1978), etc., and heat-bleachable sensitizing dyes as described in Japanese Patent Application (OPI) No. 111239/85, Japanese Patent Application No. 172967/85, etc.

These sensitizing dyes can be employed individually, and can also be employed in combination thereof. A combination of sensitizing dyes is often used, particularly for the purpose of supersensitization.

The sensitizing dyes may be present in the emulsion together with dyes which themselves do not give rise to spectrally sensitizing effects but exhibit a supersensitizing effect or substances which substantially do not absorb visible light but exhibit a supersensitizing effect. For example, those described in U.S. Pat. Nos., 2,933,390, 3,635,721, 3,743,510, 3,615,613, 3,615,641, 3,617,295, and 3,635,721, etc., are useful.

A period for the addition of the sensitizing dye to the silver halide emulsion may be before, during or after the chemical ripening, or before, during or after the formation of the nuclei of silver halide particles as described in U.S. Pat. Nos. 4,183,756 and 4,225,666.

The amount of the sensitizing dye added is generally in the range of from about $10^{-8}$ mol to about $10^{-2}$ mol per mol of silver halide.

In the present invention, an image forming accelerator can be used in the light-sensitive material. The image forming accelerator has a function which accelerates the oxidation reduction reaction between a silver salt oxidizing agent and a reducing agent, a function which accelerates a reaction of forming a dye, decomposing a dye, or releasing a mobile dye from a dye providing substance, etc., or a function which accelerates transfer of a dye from a layer of the light-sensitive material to a dye fixing layer. From the standpoint of a physicochemical function, they are classified into a group, for example, a base or base precursor, a nucleophilic compound, an organic solvent having a high boiling point (an oil), a thermal solvent, a surface active agent, a compound having an interaction with silver or a silver ion, etc. However, such groups of substances usually show complex functions and generally have some of the above described accelerating effects at the same time. The details thereof are described in Japanese Patent Application (OPI) No. 93451/86.

In the present invention, various kinds of development stopping agents can be used for the purpose of obtaining a constant image irrespective of variations in a processing temperature and a processing time at the development.

The expression "development stopping agent" used herein means a compound which can rapidly neutralize a base or react with a base to decrease concentration of the base in the layer when the development has appropriately proceeded, whereby the development is stopped, or a compound which can interact with silver or a silver salt to inhibit development.

Examples of the development stopping agents include an acid precursor which releases an acid by heating, an electrophilic compound which causes a displacement reaction with a base coexistent by heating, a nitrogen-containing heterocyclic compound, a mercapto compound, and a precursor thereof, etc. Specific examples thereof are described in Japanese Patent Application (OPI) Nos. 108837/85, 192939/85, 230133/85, and 230134/85, etc.

Further, compounds which release a mercapto compound by heating are useful and include those described in Japanese Patent Application (OPI) Nos. 67851/86, 147244/86, 124941/86, 185743/86, 182039/86, 185744/86, 184539/86, 188540/86, 53632/86, etc.

Further, in the present invention, it is possible to use a compound which activates development simultaneously while stabilizing the image. Specific examples of compounds preferably employed are described in U.S. Pat. No. 4,500,626.

In the present invention, various kinds of antifoggants can be employed. Examples of useful antifoggants include a carboxylic acid and a phosphoric acid each containing a nitrogen atom as described in Japanese Patent Application (OPI) No. 168442/84, a mercapto compound and a metal salt thereof as described in Japanese Patent Application (OPI) No. 111636/84, an acetylene compound, and the like.

In the present invention, image toning agents can be incorporated into the light-sensitive material, if desired. Effective toning agents include those as described in Japanese Patent Application (OPI) No. 147244/86.

The binder which can be used in the light-sensitive material according to the present invention can be employed individually or in a combination thereof. A hydrophilic binder can be used as the binder according to the present invention. The typical hydrophilic binder is a transparent or translucent hydrophilic binder, examples of which include a natural substance, for example, protein such as gelatin, a gelatin derivative, etc., a polysaccharide such as starch, gum arabic, a cellulose derivative, etc., and a synthetic polymeric compound, for example, a water-soluble polyvinyl compound such as polyvinyl pyrrolidone, acrylamide polymer, etc. Another example of the synthetic polymer compound is a dispersed vinyl compound in a latex form which is used for the purpose of increasing dimensional stability of a photographic material.

A suitable coated amount of the binder according to the present invention is generally 20 g/m$^2$ or less, preferably 10 g/m$^2$ or less, and more preferably 7 g/m$^2$ or less.

The amount of the organic solvent having a high boiling point which is dispersed in the binder together with the hydrophobic compound such as the dye providing substance to the binder is generaly 1 ml or less, preferably 0.5 ml or less and more preferably 0.3 ml or less per g of the binder.

In the light-sensitive material and the dye fixing material according to the present invention, the photographic emulsion layer and other binder layers may contain an inorganic or organic hardener. Specific examples of the hardeners include those as described in Japanese Patent Application (OPI) Nos. 147244/86, and 157636/84, which can be employed individually or as a combination thereof.

A support used in the heat-developable light-sensitive material and the dye fixing material employed, if desired, according to the present invention is that which can endure at the processing temperature. Not only an ordinary support such as glass, paper, a polymer film, metal or analogues thereof, but also those as described as supports in Japanese Patent Application (OPI) No. 147244/86 can be used in the present invention.

When a colored dye providing substance is incorporated into the heat-developable light-sensitive material used in the present invention, it is not so necessary to further incorporate an anti-irradiation or antihalation substance or various dyes in the light-sensitive material. However, a filter dye, an absorbing substance, etc., as described in the literatures cited in Japanese Patent Application (OPI) No. 147244/86 and U.S. Pat. No. 4,500,626 may be incorporated.

In order to reproduce a wide range of color in a chromaticity diagram using three elementary colors, i.e., yellow, magenta, and cyan, it is necessary that the light-sensitive material used in the present invention contains at least three silver halide emulsion layers each having a sensitivity in a different spectral region.

Typical examples of the combination of at least three light-sensitive silver halide emulsion layers each having a sensitivity in a different spectral region include those as described in Japanese Patent Application (OPI) No. 180550/84.

The light-sensitive material used in the present invention may have two or more light-sensitive emulsion layers which are sensitive to light of the same spectral region but have different sensitivities, if desired.

The light-sensitive material which can be used in the present invention may contain, if necessary, various additives which are known to use in heat-developable light-sensitive materials, and layers other than the light-sensitive layer, for example, an antistatic layer, a conductive layer, a protective layer, an intermediate layer, an antihalation layer, a stripping layer, a matting layer, etc. Various additives which can be used include those as described in *Research Disclosure,* RD No. 17029, pages 9 to 15 (June, 1978) and Japanese Patent Application (OPI) No. 88256/86, etc., for example, a plasticizer, a sharpness-improving dye, an antihalation dye, a sensitizing dye, a matting agent, a surface active agent, a fluorescent whitening agent, an ultraviolet ray absorbing agent, a slipping agent, an antioxidizing agent, a color fading preventing agent, etc.

In particular, it is typical to incorporate an organic or inorganic matting agent into the protective layer in order to prevent adhesion. Further, a mordant or an ultraviolet ray absorbing agent may be incorporated into the protective layer. The protective layer and the intermediate layer may be composed of two or more layers, respectively.

Moreover, the intermediate layer may contain a reducing agent for preventing color fading or color mixing, an ultraviolet ray absorbing agent, a white pigment such as $TiO_2$, etc. The white pigment may be incorporated into the emulsion layer in addition to the intermediate layer, for the purpose of increasing the sensitivity.

The photographic material according to the present invention is composed of a light-sensitive element which forms or releases a dye upon development by heating, and, if desired, a dye fixing element for fixing the dye thus formed or released. Particularly in a system wherein images are formed by diffusion transfer of dyes, both the light-sensitive element and the dye fixing element are essential. Typical photographic elements employed in such a system are divided broadly into two embodiments, viz., an embodiment in which the light-sensitive element and the dye fixing element are provided on two supports separately, and an embodiment in which the both elements are provided on the same support.

To the relationship between the light-sensitive element and the dye fixing element, the relation with a support and the relation with a white reflective layer in the present invention, those as described in Japanese Patent Application (OPI) No. 147244/86, and U.S. Pat. No. 4,500,626 can be applied.

One representative example of the embodiment in which the light-sensitive element and the dye fixing element are provided on the same support is a type in which the light-sensitive element is not necessary to peel apart from the dye fixing element after the formation of transferred images. In such a case, on a transparent or opaque support a light-sensitive layer, a dye fixing layer and a white reflective layer are superposed. Examples of preferred embodiments of layer structure include transparent support/light-sensitive layer/white reflective layer/dye fixing layer, or transparent support/dye fixing layer/white reflective layer/light-sensitive layer, etc.

Another typical example of the embodiment in which the light-sensitive element and the dye fixing element are provided on the same support is a type in which a part or all of the light-sensitive element is separated from the dye fixing element and a stripping layer is provided on an appropriate position of the element as described, for example, in Japanese Patent Application (OPI) No. 67840/81, Canadian Patent No. 674,082, U.S. Pat. No. 3,730,718, etc.

The light-sensitive element or the dye fixing element may have an electrically conductive heat generating layer suitable to use as heating means for the purpose of heat development or diffusion transfer of dyes.

A transparent or opaque electrically conductive heat generating element used in such a case can be prepared utilizing heretofore known techniques with respect to a resistance heat generator.

Such resistance heat generating element includes a thin layer of an inorganic material exhibiting semiconductor properties and a method utilizing a thin layer of an organic material composed of electrically conductive fine particles dispersed in a binder. The materials which can be employed in these methods include those as described in Japanese Patent Application (OPI) No. 29835/86, etc.

The dye fixing element which can be used in the present invention comprises at least one layer containing a mordant. When the dye fixing layer is positioned on the surface of the dye fixing element, a protective layer can be further provided, if desired.

With respect to the layer structure, the binder, the additives and the position of a layer to which a mordant is added, those as described in Japanese Patent Application (OPI) No. 147244/86 those in the patents cited therein can be applied to the present invention.

The dye fixing element used in the present invention may contain, if desired, a subsidiary layer, for example, a stripping layer, a matting layer, an anticurling layer, etc. in addition to the above described layers.

Into one or more of the layers described above, a base and/or base precursor for the purpose of accelerating dye transfer, a hydrophilic thermal solvent, a color fading preventing agent for preventing fading or dyes, an ultraviolet ray absorbing agent, a slipping agent, a matting agent, an antioxidizing agent, a dispersed vinyl compound for the purpose of increasing dimensional stability, a fluorescent whitening agent, etc. may be incorporated. Specific examples of these additives are described in Japanese Patent Application (OPI) No. 88256/86.

The binder which can be used in the above described layers is preferably a hydrophilic binder. The typical hydrophilic binder is a transparent or translucent hydrophilic colloid. Specifically, the binders as illustrated for the light-sensitive material described above can be employed.

The dye fixing layer employed in the present invention includes a dye fixing layer which can be used in heat-developable color light-sensitive materials. A mordant to be used can be selected appropriately from mordants conventionally used. Among them, polymeric mordants are particularly preferred. The polymeric mordants include polymers containing tertiary amino groups, polymers containing nitrogen-containing heterocyclic moieties, and polymers containing quaternary cationic groups thereof, etc. Specific examples thereof are described in Japanese Patent Application (OPI) No. 147244/86, and U.S. Pat. No. 4,500,626.

In the present invention, a heat-developable light-sensitive layer, a protective layer, an intermediate layer, a subbing layer, a backing layer and other layers can be produced by various coating methods as described in U.S. Pat. No. 4,500,626.

As light sources of imagewise exposure in order to record images on the heat-developable light-sensitive material, radiation including visible light can be utilized. For example, the light sources as described in Japanese Patent Application No. 147244/86 and U.S. Pat. No. 4,500,626.

Heating temperatures for the heat development step generally ranges from about 50° C. to about 250° C., and preferably ranges from about 80° C. to about 180° C. Heating temperatures for the transfer step can range from room temperature up to the temperature employed in the heat development step, and preferably from 50° C. up to a temperature lower than that employed in the heat development step by about 10° C.

Heating means used in the heat development step and/or transfer step include a hot plate, an iron, a hot roller, a heat generator utilizing carbon or titanium white, etc.

Further, the method in which development and transfer are carried out simultaneously or successively by heating in the presence of a small amount of solvent such as water as described in Japanese Patent Application (OPI) No. 218443/84, Japanese Patent Application No. 238056/86, etc., is useful. In this method, the image forming accelerator described above may preliminarily be incorporated into either the dye fixing material, the light-sensitive material, or both of them. Alternatively, the image forming accelerator may be supplied from the outside.

In the method in which development and transfer are carried out simultaneously or successively, the heating temperature is preferably from 50° C. up to the boiling point of the solvent employed. For example, when water is used as the solvent, it is preferred to heated to within the range of from 50° C. to 100° C.

Moreover, for the purpose of transfer of mobile dyes to the dye fixing layer, a solvent can be employed.

Examples of the solvents which can be used in order to accelerate development and/or to transfer mobile dyes to the dye fixing layer include water and an alkaline aqueous solution containing an inorganic alkali metal salt or an organic base (as bases, those described for the image forming accelerators can be employed). Further, a solvent having a low boiling point, and a mixture of such a solvent having a low boiling point with water or an alkaline aqueous solution, etc. can be employed. Moreover, a surface active agent, an antifoggant, a sparingly soluble metal salt and a complexing compound, etc., may be added to the solvent.

These solvents can be applied to the dye fixing material, the light-sensitive material or both of them. The amount of the solvent used can be small, for example, up to the weight of solvent corresponding to the maximum swelling volume of the whole coated layers, and preferably up to the value obtained by subtracting the total weight of the coated layers from the weight of solvent corresponding to the maximum swelling volume of the whole coated layers.

The solvent, for example, water, can accelerate formation of images and/or transfer of dyes, by providing it between the light-sensitive layer of the heat-developable light-sensitive material and the dye fixing layer of the dye fixing material, and it may be used by preliminarily incorporating it into either the light-sensitive layer, the dye fixing material, or both thereof.

The method for providing the solvent to the light-sensitive layer or the dye fixing layer are described, for example, in Japanese Patent Application (OPI) No. 147244/86.

Further, in order to accelerate transfer of dyes, a process wherein a hydrophilic thermal solvent which is solid at ambient temperature and melts at a high temperature is incorporated into the light-sensitive material or the dye fixing material can be utilized. The hydrophilic thermal solvent can be incorporated either into any of the light-sensitive material and the dye fixing material or into both of them. Although the solvent can be incorporated into any of the emulsion layer, the intermediate layer, the protective layer and the dye fixing layer, it is preferred to incorporate it into the dye fixing layer and/or adjacent layers thereto.

Examples of the hydrophilic thermal solvents include ureas, pyridines, amides, sulfonamides, imides, alcohols, oximes, and other heterocyclic compounds.

As heating means for the transfer step, those as described in Japanese Patent Application (OPI) No. 147244/86 can be employed. Further, a method can be utilized in which the dye fixing material is provided with a layer of an electrically conductive material such as graphite, carbon black and metal, etc., and is directly heated by passing an electric current through the electrically conductive layer.

The pressure under which the heat-developable light-sensitive material and the dye fixing material are brought into close contact with each other and the methods for applying the pressure are described in Japanese Patent Application (OPI) No. 147244/86 and these can be employed in the present invention.

In accordance with the present invention, the heat-developable color light-sensitive material having excellent preservability and can provide color images having a high image density and a high S/N ratio.

The present invention is explained below in greater detail with reference to the following examples, but the present invention should not be construed as being limited thereto.

EXAMPLE 1

A method for preparing a silver benzotriazle emulsion is described below.

28 g of gelatin and 13.2 g of benzotriazole were dissolved in 300 ml of water and the solution was maintained at 40° C. with stirring. A solution of 17 g of silver nitrate dissolved in 100 ml of water was added to the above prepared solution over 2 minutes. The thus prepared silver benzotriazole emulsion was adjusted in pH, precipitated, and freed of excess salts. It was then adjusted to a pH of 6.30, whereby 400 g of a silver benzotriazole emulsion was obtained.

A method for preparing the silver halide emulsion for the fifth layer and for the first layer is described below.

To an aqueous solution of gelatin (prepared by dissolving 20 g of gelatin and 3 g of sodium chloride in 1,000 ml of water maintained at 75° C.) were added simultaneously 600 ml of an aqueous solution containing sodium chloride and potassium bromide in an amount of 0.295 moles, respectively, and an aqueous solution of silver nitrate (prepared by dissolving 0.59 moles of silver nitrate in 600 ml of water) over 40 minutes at an equal addition rate while stirring thoroughly. Thus, a mono-dispersed silver chlorobromide emulsion (bromide content: 50 mol %, crystal form: cubic, average particle size: 0.40 μm) was prepared.

After washing with water and desalting, 5 mg of sodium thiosulfate and 20 mg of 4-hydroxy-6-methyl-1,3,3a,7-tetraazaindene were added and then it was subjected to chemical sensitization at 60° C. The yield of the emulsion was 600 g.

A method of preparing the silver halide emulsion for the third layer is described below.

To an aqueous solution of gelatin (prepared by dissolving 20 g of gelatin and 3 g of sodium chloride in 1,000 ml of water maintained at 75° C.) were added simultaneously 600 ml of an aqueous solution containing sodium chloride and potassium bromide in an amount of 0.295 moles, respectively and an aqueous solution of silver nitrate (prepared by dissolving 0.59 moles of silver nitrate in 600 ml of water) over 40 minutes at an equal additicn rate while stirring throughly. Thus, a mono-dispersed silver chlorobromide emulsion (bromide content: 80 mol %; crystal form: cubic; average particle size: 0.35 μm) was prepared.

After washing with water and desalting, 5 mg of sodium thiosulfate and 20 mg of 4-hydroxy-6-methyl-1,3,3a,7-tetraazaindene were added, and then it was subjected to chemical sensitization at 60° C. The yield of the emulsion was 600 g.

A method for preparing a gelatin dispersion of dye providing substance is described in the following.

A mixture of 5 g of Yellow Dye Providing Substance (Y) described below, 0.5 g of succinic acid 2-ethylhexyl ester sulfonic acid sodium salt, as a surface active agent, 2.5 g of tri-isononyl phosphate, as a solvent having a high boiling point, and 30 ml of ethyl acetate was dissolved by heating at about 60° C. to prepare a uniform solution. This solution was mixed with 100 g of a 10% aqueous solution of lime-processed gelatin with stirring, and the mixture was dispersed by means of a homogenizer at 10,000 rpm for 10 minutes. The dispersion thus obtained was designated as the dispersion of yellow dye providing substance.

A dispersion of magenta dye providing substance was prepared in the same manner for the dispersion of yellow dye providing substance as described above, except using Magenta Dye Providing Substance (M) described below. Further, a dispersion of cyan dye providing substance was prepared in the same manner as for the dispersion of yellow dye providing substance as described above, except using Cyan Dye Froviding Substance (C) described below.

A color light-sensitive material having a multilayer structure as shown in Table I below was prepared. In the following table, the coated amount of each component is set forth in parentheses.

TABLE 1

| | |
|---|---|
| Sixth Layer | Gelatin (800 mg/m$^2$), Hardener*3 (16 mg/m$^2$), Silica*4 (100 mg/m$^2$), Basic zinc carbonate (0.4 g/m$^2$) |
| Fifth Layer (Green-sensitive emulsion layer) | Silver chlorobromide emulsion (bromide: 50 mol %, silver: 400 mg/m$^2$), Silver benzotriazole emulsion (silver: 100 mg/m$^2$), Sensitizing dye D-1 ($1 \times 10^{-6}$ mol/m$^2$), Hardener*3 (16 mg/m$^2$), Developing agent (0.45 mmol/m$^2$), Yellow dye providing substance (Y) (440 mg/m$^2$), Gelatin (1,000 mg/m$^2$), Solvent having a high boiling point*1 (220 mg/m$^2$), Surface active agent*2 (100 mg/m$^2$) |
| Fourth Layer (Intermediate layer) | Gelatin (900 mg/m$^2$), Hardener*3 (18 mg/m$^2$), Basic zinc carbonate (0.4 g/m$^2$) |
| Third layer (Red-sensitive emulsion layer) | Silver chlorobromide emulsion (bromide: 80 mol %, silver: 300 mg/m$^2$), Silver benzotriazole emulsion (silver: 100 mg/m$^2$) Sensitizing dye D-2 ($8 \times 10^{-7}$ mol/m$^2$), Hardener*3 (18 mg/m$^2$), Developing agent (0.35 mmol/m$^2$), |

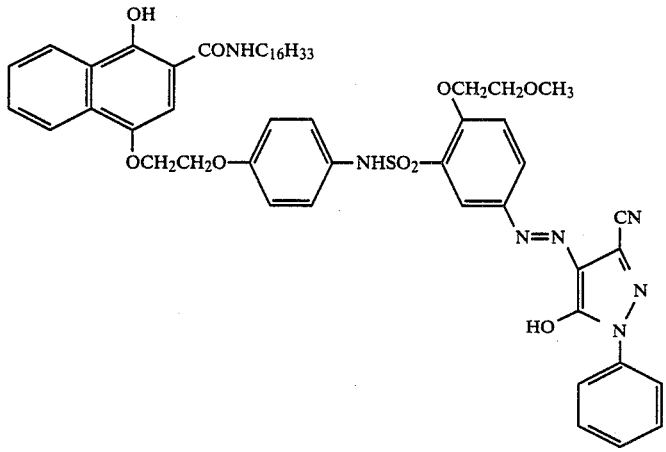

(Y)

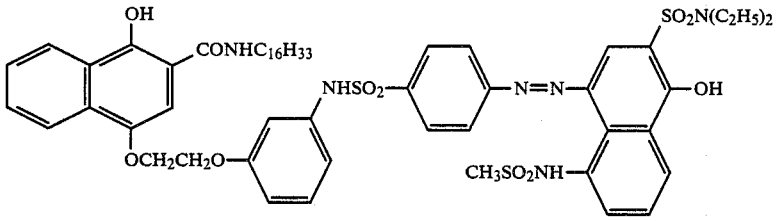

(M)

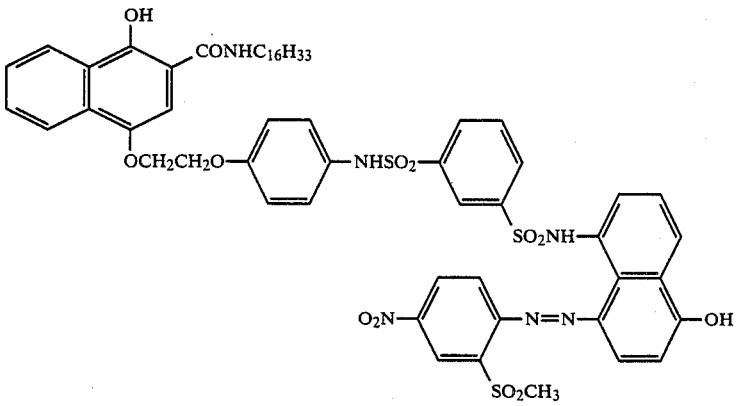

(C)

TABLE 1-continued

| | |
|---|---|
| | Magenta dye providing substance (M) (400 mg/m$^2$), Gelatin (1,000 mg/m$^2$) Solvent having a high boiling point*1 (200 mg/m$^2$), Surface active agent*2 (100 mg/m$^2$) |
| Second layer (Intermediate layer) | Gelatin (800 mg/m$^2$), Hardener*3 (16 mg/m$^2$), Basic zinc carbonate (0.4 g/m$^2$) |
| First Layer (Infrared-sensitive emulsion layer) | Silver chlorobromide emulsion (bromide: 50 mol %, silver: 300 mg/m$^2$), Silver benzotriazole emulsion (Silver: 100 mg/m$^2$), Sensitizing dye D-3 ($1 \times 10^{-6}$ mol/m$^2$), Hardener*3 (16 mg/m$^2$), Developing agent (0.35 mmol/m$^2$), Cyan dye providing substance (C) (300 mg/m$^2$), Gelatin (1,000 mg/m$^2$), Solvent having a high boiling point*1 (150 mg/m$^2$), Surface active agent*2 (100 mg/m$^2$) |
| Support*5 | |

*1(iso-$C_9H_{19}O)_3$ P=O

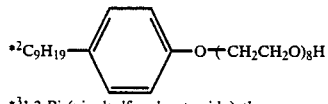

*3 1,2-Bis(vinylsulfonylacetamido)ethane
*4 Size: 3 to 5 μm
*5 Polyethylene terephthalate support

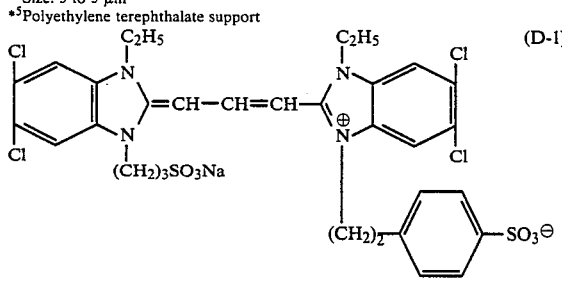

(D-1)

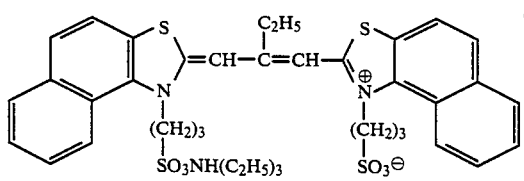

(D-2)

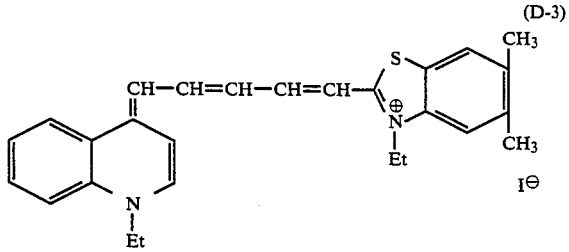

(D-3)

Developing agents used in several light-sensitive materials prepared in accordance with Table 1 are set forth in Table 2 below.

TABLE 2

| Light-Sensitive Material No. | Developing Agent |
|---|---|
| A-1 | 2,6-Dichloro-p-aminophenol (Comparison) |
| A-2 | Compound 1 (Present Invention) |
| A-3 | Compound 2 (Present Invention) |
| A-4 | Compound 5 (Present Invention) |
| A-5 | Compound 6 (Present Invention) |
| A-6 | Compound 8 (Present Invention) |

A method for preparing a dy fixing material is described below.

On a paper support laminated with polyethylene, the layers having the compositions shown in Table 3 below were coated to prepare a dye fixing material.

TABLE 3

| | |
|---|---|
| Second Layer | Gelatin (0.7 g/m$^2$), Hardener*1 (0.24 g/m$^2$) |
| First Layer | Gelatin (1.4 g/m$^2$), Mordant*2 (2.6 g/m$^2$), Guanidine picrate (2.5 g/m$^2$) |
| | Support |

*1 1,2-Bis(vinylsulfonylacetamido)ethane

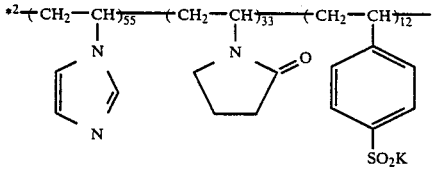

The above described multilayer color light-sensitive material was exposed through a three color separation filter of G, R, and IR (G: filter transmitting a band of 500 nm to 600 nm, R: filter transmitting a band of 600 nm to 700 nm IR: filter transmitting a band of 700 nm or more), the density of which continuously changes, for 1 second at 500 lux using a tungsten lamp.

The emulsion layer side of the thus exposed light-sensitive material was applied 20 ml/m$^2$ of water using a wire bar, and the light-sensitive material was then superimposed on the dye fixing material described above in such a manner that their coated layers were in contact with each other. After heating for 30 seconds using a heat roller which was adjusted so as to render the temperature of the water-absorbed layer at 90° C., the dye fixing material was separated from the light-sensitive material, whereupon clear yellow, magenta and cyan color images were obtained on the dye fixing material corresponding to the three color separation filter of G, R and IR respectively.

The maximum density (Dmax) and the minimum density (Dmin) of each color were measured using a Macbeth reflection densitometer (Model RD-519).

The results thus obtained are shown in Table 4 below.

Further, the above-described light-sensitive materials were preserved at 50° C. for 1 week and then subjected to the image exposure and heating in the same manner as described above. The minimum densities thus obtained are also shown in Table 4 below.

TABLE 4

| Light-Sensitive Material No. | Immediately After Preparation of Light-Sensitive Material | | | | | | After Preservation at 50° C. for 1 Week | | |
|---|---|---|---|---|---|---|---|---|---|
| | Maximum Density | | | Minimum Density | | | Minimum Density | | |
| | Yellow | Magenta | Cyan | Yellow | Magenta | Cyan | Yellow | Magenta | Cyan |
| A-1 (Comparison) | 1.89 | 2.00 | 1.98 | 0.20 | 0.24 | 0.22 | 0.55 | 0.48 | 0.62 |
| A-2 (Present Invention) | 1.69 | 1.83 | 1.81 | 0.11 | 0.20 | 0.13 | 0.14 | 0.23 | 0.17 |

TABLE 4-continued

| Light-Sensitive Material No. | Immediately After Preparation of Light-Sensitive Material | | | | | | After Preservation at 50° C. for 1 Week | | |
|---|---|---|---|---|---|---|---|---|---|
| | Maximum Density | | | Minimum Density | | | Minimum Density | | |
| | Yellow | Magenta | Cyan | Yellow | Magenta | Cyan | Yellow | Magenta | Cyan |
| A-3 (Present Invention) | 1.61 | 1.80 | 1.82 | 0.13 | 0.17 | 0.11 | 0.20 | 0.20 | 0.17 |
| A-4 (Present Invention) | 1.71 | 1.79 | 1.81 | 0.11 | 0.18 | 0.15 | 0.17 | 0.18 | 0.18 |
| A-5 (Present Invention) | 1.70 | 1.80 | 1.74 | 0.12 | 0.18 | 0.14 | 0.20 | 0.18 | 0.17 |
| A-6 (Present Invention) | 1.70 | 1.77 | 1.82 | 0.13 | 0.19 | 0.14 | 0.16 | 0.20 | 0.16 |

From the results shown in Table 4, it is apparent that the compounds according to the present invention are excellent in stability during preservation. More specifically, with respect to the increase in the minimum density when compared the minimum density obtained from the fresh light-sensitive material with that obtained from the light-sensitive material after preservation at 50° C. for 1 week (that is, increase in fog upon preservation), the compounds according to the present invention show a small increase in fog and thus the low minimum density is maintained, although a severe increase in fog is observed with the comparative developing agent.

EXAMPLE 2

Light-Sensitive Materials B-1 to B-6 were prepared in the same manner as described for Light-Sensitive Materials A-1 to A-6 described in Example 1, except using guanidine 4-acetylaminophenylpropiolate in an amount of 500 mg/m$^2$ in the first layer, 600 mg/m$^2$ in the second layer, 450 mg/m$^2$ in the third layer, 600 mg/m$^2$ in the fourth layer, 500 mg/m$^2$ in the fifth layer and 600 mg/m$^2$ in the sixth layer and eliminating the basic zinc carbonate from the second, fourth and sixth layers.

A dye fixing material was prepared in the same manner as described in Example 1, except eliminating guanidine picrate.

The above described light-sensitive materials were exposed through the same three color separation filter as described in Example 1 for 1 second at 500 lux, and then heated for 20 seconds on a heat block which had been heated at 150° C.

To the coated layer of the dye fixing material was applied 20 ml/m$^2$ of water using a wire bar. The thus heated light-sensitive material described above was then superimposed on the dye fixing material in such a manner that their coated layers were in contact with each other, and heated for 10 seconds using a heat roller at 90° C. The dye fixing material was separated from the light-sensitive material, whereupon color images corresponding to the three color separation filter were obtained on the dye fixing material.

In the same manner as described in Example 1, the maximum density and the minimum density of the fresh light-sensitive material and the minimum density of the light-sensitive material after preservation at 50° C. for 1 week were measured. The results thus obtained are shown in Table 5 below.

TABLE 5

| Light-Sensitive Material No. | Immediately After Preparation of Light-Sensitive Material | | | | | | After Preservation at 50° C. for 1 Week | | |
|---|---|---|---|---|---|---|---|---|---|
| | Maximum Density | | | Minimum Density | | | Minimum Density | | |
| | Yellow | Magenta | Cyan | Yellow | Magenta | Cyan | Yellow | Magenta | Cyan |
| B-1 (Comparison) | 1.85 | 2.05 | 2.00 | 0.25 | 0.28 | 0.24 | 0.65 | 0.59 | 0.55 |
| B-2 (Present Invention) | 1.74 | 1.88 | 1.78 | 0.20 | 0.18 | 0.17 | 0.30 | 0.24 | 0.25 |
| B-3 (Present Invention) | 1.76 | 1.80 | 1.80 | 0.16 | 0.17 | 0.16 | 0.24 | 0.24 | 0.23 |
| B-4 (Present Invention) | 1.70 | 1.85 | 1.84 | 0.18 | 0.19 | 0.18 | 0.24 | 0.20 | 0.24 |
| B-5 (Present Invention) | 1.72 | 1.84 | 1.78 | 0.16 | 0.14 | 0.16 | 0.22 | 0.19 | 0.19 |
| B-6 (Present Invention) | 1.70 | 1.78 | 1.82 | 0.16 | 0.14 | 0.17 | 0.20 | 0.20 | 0.21 |

From the results shown in Table 5, it is apparent that the compounds according to the present invention provide images excellent in stability at the minimum density, as in example 1.

EXAMPLE 3

A method for preparing a hexahedral monodispersed silver iodobromide emulsion is described below.

To an aqueous solution of gelatin (prepared by dissolving 20 g of gelatin and 0.5 g of $HO(CH_2)_2S(CH_2S(CH_2)_{20}OH$ in 1,000 ml of water maintained at 50° C.), an aqueous solution containing 69 g of potassium bromide and 2 g of potassium iodide and an aqueous solution of silver nitrate (prepared by dissolving 0.59 moles of silver nitrate in 600 ml of water) were added by using a double jet method while maintaining the pAg at 8.0 and stirring thoroughly.

After washing with water and desalting, 40 g of gelatin and 200 ml of water were added, the pH was adjusted and the emulsion was subjected the optimum chemical sensitization using sodium tiosulfate, whereupon 700 g of a hexahedral monodispersed emulsion having an average particle size of 0.45 μm was obtained.

A method for preparing a dispersion of a dye forming coupler is described below.

A mixture of 100 g of a 10% aqueous solution of gelatin, 10 ml of a 5% aqueous solution of sodium dodecylbenzenesulfonate, 0.014 moles of Dye Forming Coupler M described below, 5 g of trinonyl phosphate, and 20 ml of ethyl acetate were dispersed by means of a homogenizer to prepare a dispersion of dye forming coupler.

A method for preparing a Light-Sensitive Material C-1 is described below.

| | | |
|---|---|---|
| (a) | Hexahedral monodispersed silver iodobromide emulsion | 50 g |
| (b) | 10% Aqueous solution of gelatin | 15 g |
| (c) | 0.04% Methanol solution of Sensitizing Dye S having the formula shown below | 5 ml |
| (d) | Dispersion of Dye Forming Coupler M | 32 g |
| (e) | 10% Methanol solution of a compound having the following formula: | 15 ml |

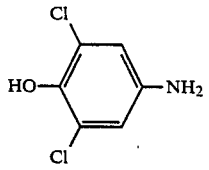

| | | |
|---|---|---|
| (f) | 5% Aqueous solution of a compound having the following formula: | 15 ml |

-continued

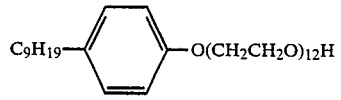

| | | |
|---|---|---|
| (g) | Water | 168 ml |

The above described components (a) to (g) were mixed with stirring and the mixture was coated on a paper support laminated with polyethylene so as to have a wet layer thickness of 30 μm, and was then dried.

Sensitizing Dye S

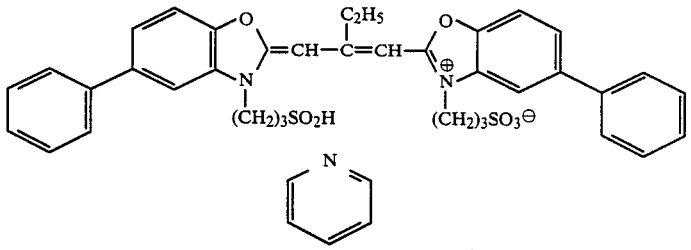

Dye Forming Coupler M

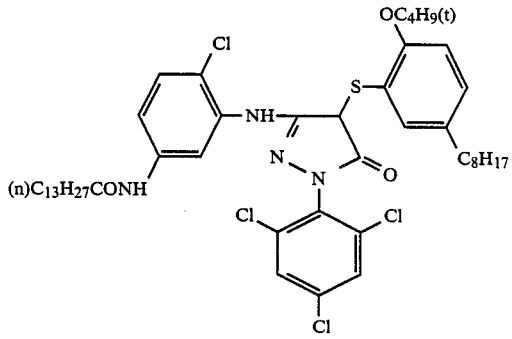

Further, on the thus-formed layer, a solution containing 400 g of a 10% aqueous solution of gelatin, 1,600 ml of water, 20 ml of a 4% aqueous solution of 1,2-bis(vinylsulfonylacetamido)ethane and 250 ml of a 1% aqueous solution of succinic acid 2-ethylhexyl ester sulfonic acid sodium salt was coated to have a wet layer thickness of 42 μm and then dried to prepare Light-Sensitive Material C-1.

Light-Sensitive Materials C-2 and C-3 were prepared in the same manner as described for Light-Sensitive Material C-1 except using 0.084 moles of Compounds 1 and 2 according to the present invention in place of the developing agent for (e).

Light-Sensitive Materials C-1, C-2 and C-3 were exposed through a green filter, the density of which continuously changed, for 1 second at 5,000 lux using a tungsten lamp. To the emulsion layer side of the exposed light-sensitive material, 14 ml/m$^2$ of a 5% aqueous solution of guinidine carbonate was applied, using a wire bar, a polyethylene terephthalate film was superimposed on the light-sensitive material, and heated at 90° C. for 10 seconds. As a result, a clear magenta negative image was obtained on the light-sensitive material.

Further, these light-sensitive materials were subjected to preservation at 50° C. for 4 days and then to the same exposure and development processing as described above. The minimum density of Light-Sensitive Material C-1 was 0.5. On the contrary, in Light-Sensitive Materials C-2 and C-3, according to the present invention, the minimum densities were less than 0.2 respectively. These results clearly illustrate the stability during preservation of the compounds according to the present invention.

EXAMPLE 4

A method for preparing a hexahedral mono-dispersed silver iodobromide emulsion is described below.

To an aqueous solution of gelatin (prepared by dissolving 20 g of gelatin and 0.5 g of $HO(CH_2)_2S(CH_2)_2S(CH_2)_2OH$ in 1,000 ml of water and maintained at 50° C.), aqueous solution containing 69 g of potassium bromide and 2 g of potasiium iodide and an aqueous solution of silver nitrate (prepared by dissolving 0.59 moles of silver nitrate in 600 ml of water were added by using a double jet method while maintaining the pAg at 8.0 while stirring thoroughly.

After washing with water and desalting, 40 g of gelatin and 200 ml of water were added, the pH as adjusted and the emulsion was subjected the optimum chemical sensitization using sodium thiosulfate, whereupon 700 g of a hexahedral monodispersed emulsion having an average grain size of 0.45 μm was obtained.

A method for preparing a dispersion of a dye forming coupler is described below.

A mixture of 100 g of a 10% aqueous solution of gelatin, 10 ml of a 5% aqueous solution of sodium dodecyllenzenesulfonate, 0.014 moles of Dye Forming Coupler D described below, 5 g of trinonyl phosphate and 20 ml of ethyl acetate was dispersed by means of a homogenizer to prepare a dispersion of dye forming coupler.

A method for preparing a Light-Sensitive Material D-1 is described below.

| | | |
|---|---|---|
| (a) | Hexahedral monodispersed silver iodobromide emulsion | 50 g |
| (b) | 10% Aqueous solution of gelatin | 15 g |
| (c) | 0.04% Methanol solution of Sensitizing Dye S having the formula shown below | 5 ml |
| (d) | Dispersion of Dye Forming Coupler D | 32 g |
| (e) | 10% Methanol solution of a compound having the following formula: 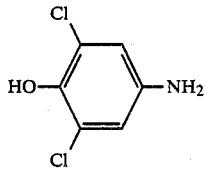 | 15 ml |
| (f) | 5% Aqueous solution of a compounds having the following formula: 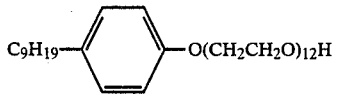 | 15 ml |
| (g) | Guanidine 3-acetylamino-4-methoxyphenyl propiolate | 0.70 g |
| (h) | Water | 168 ml |

The above described components (a) to (h) were mixed with stirring and the mixture was coated on a polyethylene terephthalate film support to have a wet layer thickness of 75 μm and then dried.

Sensitizing Dye S

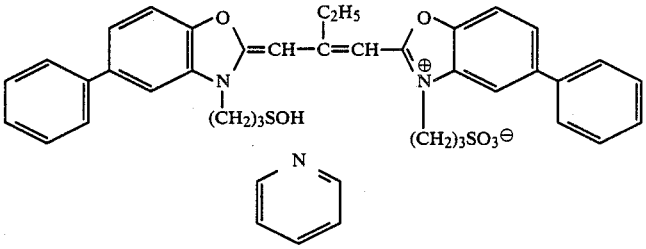

Dye Forming Coupler D

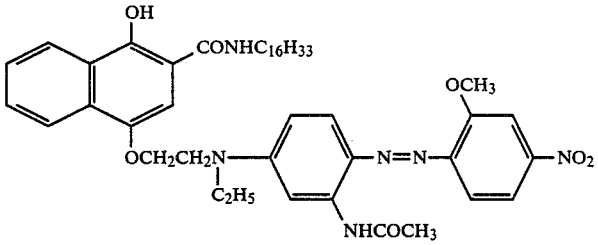

Further, on the thus-formed layer, a solution containing 400 g of a 10% aqueous solution of gelatin, 1,600 ml of water, 20 ml of a 4% aqueous solution of 1,2-bis(-vinylsulfonylacetamido)ethane and 250 ml of a 1% aqueous solution of succinic acid 2-ethylhexyl ester sulfonic acid sodium salt was coated to have a wet layer thickness of 42 μm and then dried to prepare Light-Sensitive Material D-1.

Light-Sensitive Material D-2 was prepared in the same manner as described for Light-Sensitive Material D-1, except using 0.084 moles of Compound 1 according to the present invention in place of the developing agent for (e).

Light-Sensitive Materials D-1 and D-2 were exposed through a green filter, the density of which continuously changed, for 1 second at 5,000 lux using a tungsten lamp. The thus exposed light-sensitive materials were heated for 60 seconds on a hot plate which had been heated at 170° C., and then the emulsion layer coated was physically peeled off. As a result, a magenta color image was obtained on the polyethylene terephthalate film. The maximum density and the minimum density of the image were measured using a Macbeth transmission densitometer (Model TD-504). The results thus obtained are shown in Table 6 below.

TABLE 6

| Light-Sensitive Material No. | Developing Agent | Maximum Density | Minimum Density |
|---|---|---|---|
| D-1 | 2,6-Dichloro-p-amino-phenol (Comparison) | 1.48 | 0.11 |
| D-2 | Compound 1 (Present Invention) | 1.39 | 0.10 |

Further, these light-sensitive materials were preserved at 50° C. for 7 days and then subjected to the same exposure and development processing as described above. A remarkable difference was observed between the minimum density of Light-Sensitive Material D-1 for comparison and the minimum density of Light-Sensitive Material D-2 according to the present invention. The results obtained by measurement using a Macbeth transmission densitometer (Model TD-504) are shown in Table 7 below.

TABLE 7

| Light-Sensitive Material No. | Developing Agent | Maximum Density | Minimum Density |
|---|---|---|---|
| D-1 | 2,6-D-chloro-p-amino-phenol (Comparison) | 1.45 | 0.35 |
| D-2 | Compound 1 (Present Invention) | 1.41 | 0.11 |

From the results shown above, it is clear that the compound according to the present invention is very helpful in providing stable images.

In accordance with the present invention, the heat-developable color light-sensitive material having excellent preservability and can provide color images having a high image density and a high S/N ratio.

While the invention has been described in detail and with reference to specific embodiments thereof, it will be apparent to one skilled in the art that various changes and modification can be made therein without departing from the spirit and scope thereof.

What is claimed is:

1. A method for forming an image comprising heating in the presence of at least one of a base and a base generating agent, an image-wise exposed heat-developable color light-sensitive material which comprises a support having thereon at least: (1) a light-sensitive silver halide, (2) a coupler capable of coupling with an oxidation product of a developing agent, (3) a hydrophilic binder, and (4) at least one compound represented by formula (Z), the at least one compound represented by formula (Z) being a precursor of a developing agent:

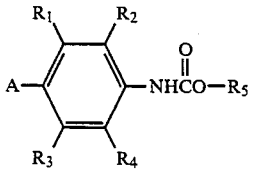

[Z]

wherein $R_1$, $R_2$, $R_3$, and $R_4$ each represents a hydrogen atom, a halogen atom, an alkyl group, an alkenyl group, a cycloalkyl group, an aralkyl group, a hydroxy group, an amino group, a substituted amino group, an alkoxy group, an acylamino group, an alkylsulfonylamino group, an arylsulfonylamino group, an aryl group, a carbamoyl group, a substituted carbmoyl group, a sulfamoyl group, a substituted sulfamoyl group, an acyl group, an acycloxy group, or an alkoxycarbonyl group, or $R_1$ and $R_2$, or $R_3$ and $R_4$ are connected together to form a ring structure; A represents a hydroxy group, a group capable of providing a hydroxy group upon reaction with a nucleophilic reagent, or the group

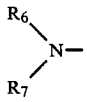

wherein $R_6$ and $R_7$ each represents a hydrogen atom, a substituted or unsubstituted alkyl group, a substituted or unsubstituted alkenyl group, a substituted or unsubstituted cycloalkyl group, or a substituted or unsubstituted aralkyl group, or $R_6$ and $R_7$ are connected together to form a heterocyclic group, or when A repesents the group

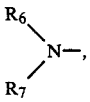

at least one combination of $R_1$ and $R_6$ and $R_3$ and $R_7$ is connected together to form a heterocyclic group; and $R_5$ represents a substituted or unsubstituted aryl group or a substituted or unsubstituted heterocyclic group.

2. A method for forming an image as in claim 1, wherein each of the alkyl groups represented by $R_1$, $R_2$, $R_3$, or $R_4$ has from 1 to 32 carbon atoms.

3. A method for forming an image as in claim 1, wherein each of the alkenyl groups represented by $R_1$, $R_2$, $R_3$, or $R_4$ has from 2 to 32 carbon atoms.

4. A method for forming an image as in claim 1, wherein each of the cycloalkyl groups represented by $R_1$, $R_2$, $R_3$, or $R_4$ has from 3 to 8 carbon atoms.

5. A method for forming an image as in claim 1, wherein each of the aralkyl groups represented by $R_1$, $R_2$, $R_3$, or $R_4$ has from 7 to 18 carbon atoms.

6. A method for forming an image as in claim 1, wherein each of the alkoxy groups represented by $R_1$, $R_2$, $R_3$, or $R_4$ has from 1 to 32 carbon atoms.

7. A method for forming an image as in claim 1, wherein each of the acylamino groups represented by $R_1$, $R_2$, $R_3$, or $R_4$ has from 2 to 32 carbon atoms.

8. A method for forming an image as in claim 1, wherein each of the alkylsulfonylamino groups represented by $R_1$, $R_2$, $R_3$, or $R_4$ has from 1 to 32 carbon atoms.

9. A method for forming an image as in claim 1, wherein each of the arylsulfonylamino groups represented by $R_1$, $R_2$, $R_3$, or $R_4$ has from 6 to 18 carbon atoms.

10. A method for forming an image as in claim 1, wherein each of the acyl groups represented by $R_1$, $R_2$, $R_3$, or $R_4$ has from 2 to 32 carbon atoms.

11. A method for forming an image as in claim 1, wherein each of the acyloxy groups represented by $R_1$, $R_2$, $R_3$, or $R_4$ has from 2 to 32 carbon atoms.

12. A method for forming an image as in claim 1, wherein each of the alkoxycarbonyl groups represented by $R_1$, $R_2$, $R_3$, or $R_4$ has from 2 to 32 carbon atoms.

13. A method for forming an image as in claim 1, wherein $R_5$ represents a substituted or unsubstituted aryl group having 6 to 20 carbon atoms or a 5- or 6-membered substituted or unsubstituted heterocyclic group.

14. A method for forming an image as in claim 1, wherein the group capable of providing a hydroxy group upon reaction with a nucleophilic reagent is an acyloxy group, an alkylsulfonyloxy group, an arylsulfonyloxy group, an alkoxycarbonyloxy group, an aryloxycarbonyloxy group, a dialkylphosphoryloxy group, or a diarylphosphoryloxy group.

15. A method for forming an image as in claim 1, wherein $R_1$, $R_2$, $R_3$, and $R_4$ each represents a hydrogen atom, a halogen atom, an alkyl group, an alkoxy group, an acylamino group, an aryl group, a carbamoyl group, or a substituted carbamoyl group.

16. A method for forming an image as in claim 1, wherein A represents a hydroxy group, an acyloxy group, an alkylsulfonyloxy group, an arylsulfonyloxy group, an alkoxycarbonyloxy group, an aryloxycarbonyloxy group, a dialkylphosphoryloxy group, a diarylphosphoryloxy group, a dialkylamino group, a pyrrolidino group, a piperidino group, or a morpholino group.

17. A method for forming an image as in claim 1, wherein the compound represented by formula (Z) is present in an amount of from about 0.1 to about 10 mol per mol of the total coated amount of silver contained in the light-sensitive material.

18. A method for forming an image as in claim 17, wherein the compound represented by formula (Z) is present in an amount of from 0.2 to 3 mol per mol of the total coated amount of silver contained in the light-sensitive material.

19. A method for forming an image as in claim 1, wherein the coupler is an active methylene compound, an active methine compound, a phenol compound, a naphthol compound, a pyrazole compound, or a condensed pyrazole compound.

20. A method for forming an image as in claim 1, wherein the heating temperature for the heating development step is in the range of from about 50° C. to about 250° C.

* * * * *